United States Patent [19]

Vidusek

[11] Patent Number: 5,072,883

[45] Date of Patent: Dec. 17, 1991

[54] FULL CONE SPRAY NOZZLE WITH EXTERNAL AIR ATOMIZATION

[75] Inventor: Daniel A. Vidusek, St. Charles, Ill.

[73] Assignee: Spraying Systems Co., Wheaton, Ill.

[21] Appl. No.: 504,321

[22] Filed: Apr. 3, 1990

[51] Int. Cl.[5] ..... B05B 1/28; B05B 7/10; B05B 7/06; B05B 1/34

[52] U.S. Cl. ..... 239/290; 239/403; 239/424; 239/487

[58] Field of Search ..... 239/290, 299, 403, 424, 239/434.5, 487

[56] References Cited

U.S. PATENT DOCUMENTS

| | | | |
|---|---|---|---|
| 143,555 | 10/1873 | Averell . | |
| 1,751,787 | 3/1930 | Binks . | |
| 2,416,923 | 3/1947 | Jenkins . | |
| 2,511,356 | 6/1950 | Mantle . | |
| 2,743,963 | 5/1956 | Peeps . | |
| 3,072,346 | 1/1963 | Wahlin et al. | 239/487 |
| 3,293,166 | 12/1966 | Cowing . | |
| 3,332,623 | 7/1967 | Gallant . | |
| 3,565,324 | 1/1972 | Rebula et al. . | |
| 3,746,262 | 7/1973 | Bete et al. . | |
| 3,865,314 | 2/1975 | Levey et al. . | |
| 3,952,955 | 4/1976 | Clements . | |
| 4,236,674 | 12/1980 | Dixon . | |
| 4,273,287 | 6/1981 | Huber | 239/299 |
| 4,273,293 | 6/1981 | Hastings | 239/424 |
| 4,386,739 | 6/1983 | Kwok . | |
| 4,392,617 | 7/1983 | Bakos et al. . | |
| 4,544,100 | 10/1985 | Simashkevich et al. | 239/424 |
| 4,645,127 | 2/1987 | Emory et al. . | |
| 4,650,119 | 3/1987 | Pomponi, Jr. . | |

FOREIGN PATENT DOCUMENTS

| | | | |
|---|---|---|---|
| 2702191 | 3/1978 | Fed. Rep. of Germany . | |
| 993854 | 11/1951 | France | 239/290 |
| 395793 | 7/1933 | United Kingdom . | |
| 1587898 | 4/1981 | United Kingdom . | |
| 1600631 | 10/1981 | United Kingdom . | |

*Primary Examiner*—Andres Kashnikow
*Assistant Examiner*—Lesley D. Morris
*Attorney, Agent, or Firm*—Leydig, Voit & Mayer

[57] ABSTRACT

A full cone spray nozzle assembly having a body with a centrally disposed, axially extending chamber through which a liquid to be discharged will flow, and a frusto-conically formed end cap having a circular, centrally located discharge opening. The end cap covers the body at the discharge end thereof, and the body has passages to direct pressurized air into a cavity formed between the discharge end of the body and the adjacent interior surface of the conical cap, thus forming an air outlet in the shape of an annular slot. The slot is arranged to direct the pressurized air inwardly towards the center of the opening in the conical cap so that the pressurized air surrounds and impinges the liquid flowing from the orifice and atomizes the liquid discharge.

8 Claims, 2 Drawing Sheets

FULL CONE SPRAY NOZZLE WITH EXTERNAL AIR ATOMIZATION

BACKGROUND OF THE INVENTION

The present invention relates generally to spray nozzles, and more particularly to air atomizing spray nozzles of the type that generate a spray pattern in which liquid droplets are distributed uniformly throughout the spray pattern, and which finds particular, but not exclusive, utility in apparatus for the continuous casting of steel slabs, ingots, billets or the like. Such nozzles are often called "full cone spray nozzles" and are distinct from nozzles which generate hollow cone shaped patterns in which the liquid droplets discharge in an annular pattern with a central air core.

In both full cone and hollow cone spray nozzles, it is known to assist liquid atomization by directing pressurized air streams to engage the discharging liquid spray. This can be accomplished by converging the pressurized liquid and air streams within the body of the nozzle prior to discharge of the liquid stream. In hollow cone spray nozzles, it is also known to direct a pressurized air stream into impingement with the discharge liquid at a point external to the discharge orifice of the nozzle. Such external atomization is less frequently employed with full cone spray nozzles, because of an inability to effectively atomize the full cone spray pattern. The present invention addresses this difficulty and provides a full cone spray nozzle assembly that directs pressurized air to coact with a centrally located jet of liquid downstream of, and thus external to, the liquid orifice.

The present invention also provides a full cone spray nozzle that will discharge a substantially uniform pattern of fine droplets even if there is a dislocation or interruption in the supply of pressurized air. Such a disruption could result from a compressor failure, a valve blockage, a break in the supply line, or an electrical power outage. Because the distribution of coolant emanating from the nozzle assembly will remain substantially uniform under these circumstances, problems that might occur in a casting when coolant is applied in excessive amounts on some areas, and sparse amounts or none on adjacent areas, are essentially eliminated.

The following patents disclose various nozzle arrangements in which a liquid stream is atomized by pressurized air: U.S. Pat. No. 4,645,127 to Emory et al., and assigned to Spraying Systems Co. of Wheaton, Ill.; U.S. Pat. No. 4,386,739 to Kwok; U.S. Pat. No. 4,236,674 to Dixon; and West German patent 27 02 191.

OBJECTS AND SUMMARY OF THE INVENTION

The general object of the present invention is to provide an air atomizing nozzle adapted to discharge a full cone spray in which the liquid droplets are substantially uniformly distributed throughout the spray pattern.

Another object of the invention is to provide a spray nozzle as characterized above wherein the discharge constitutes a relatively wide spray pattern of substantially uniform thickness and fine droplet size even in the event the air supply to the nozzle is interrupted or discontinued.

A further object of the invention is to provide an air atomizing nozzle which will be of simple, economical construction, and which can be easily disassembled for cleaning and quickly reassembled for operation.

Still another object of the invention is to provide a spray nozzle assembly of the foregoing type which includes a whirl imparting vane.

A more particular object of the invention is to provide an air atomizing, full cone spray nozzle, as set forth above, in which pressurized jets of air are channeled to coact with the liquid discharge at a point downstream of, and thus external to, the liquid discharge orifice. It is a related object of the invention to provide an air atomizing full cone spray nozzle, of the foregoing character, in which atomizing jets of air are directed inwardly toward the centerline of the nozzle.

Other objects and advantages of the invention will be more readily apparent upon reading the following detailed description of a preferred exemplary embodiment and upon reference to the accompanying drawings, wherein:

DETAILED DESCRIPTION OF THE INVENTION

Figure 1:
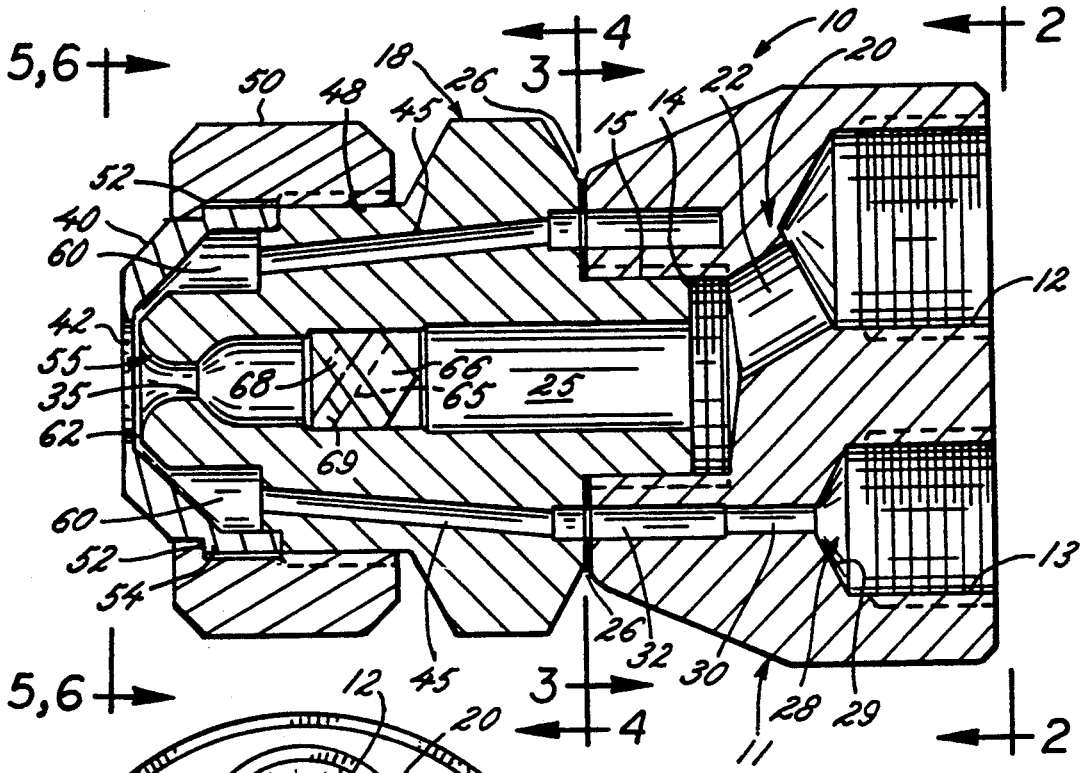
FIG. 1 is an axial view through an illustrative air atomizing spray nozzle exemplifying the present invention.

Referring more particularly to the drawings, there is shown in FIG. 1 an illustrative air assisted spray nozzle assembly embodying the present invention. The nozzle assembly, shown generally as 10, includes a hollow support body 11 having a first threaded socket 12 for attachment to a source of pressurized liquid, such as pressurized water, and a second threaded socket 13 for attachment to a source of pressurized air. The support body 11 includes a threaded axial socket 14 which serves as a mounting for an annular threaded hub 15 associated with the nozzle body or nozzle tip assembly 18. This mounting arrangement aligns the hollow support body and the nozzle tip assembly and ensures that these parts will be in proper registration.

Figure 2:
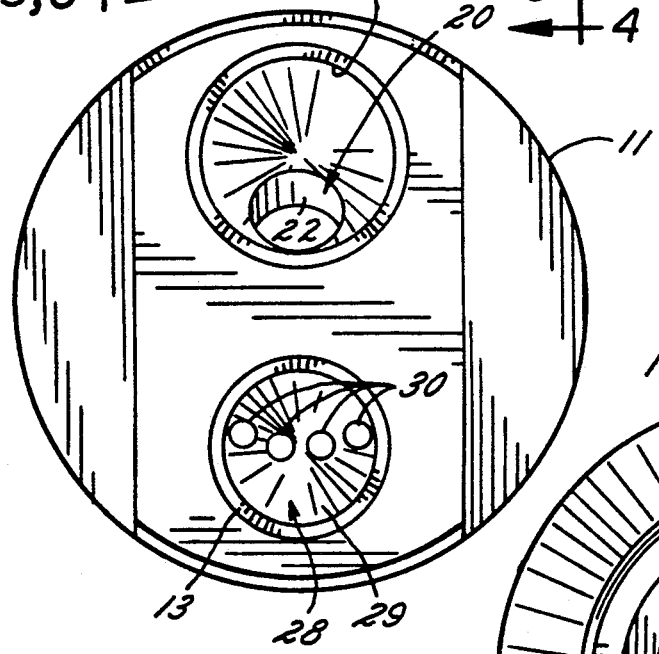
FIG. 2 is an elevational view of the end of the nozzle taken in the plane of line 2—2 in FIG. 1, and showing two coupling sockets for attachment to sources of pressurized air and pressurized liquid.
Figure 3:
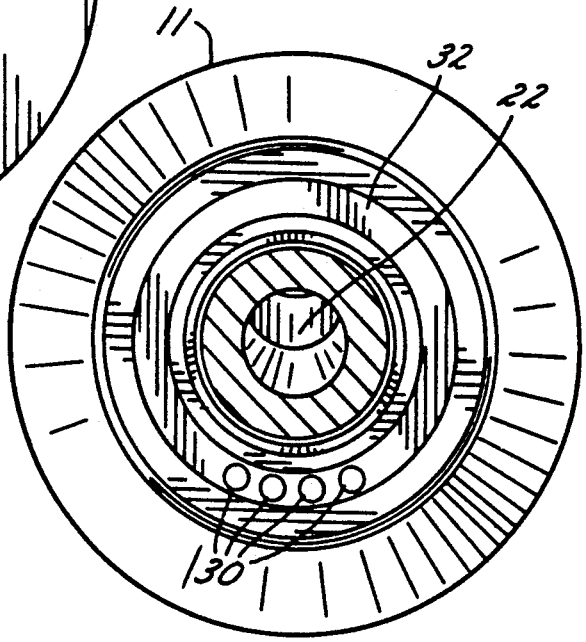
FIGS. 3 and 4 are cross sectional views substantially as seen, respectively, along lines 3—3 and 4–4 in FIG. 1.
Figure 4:
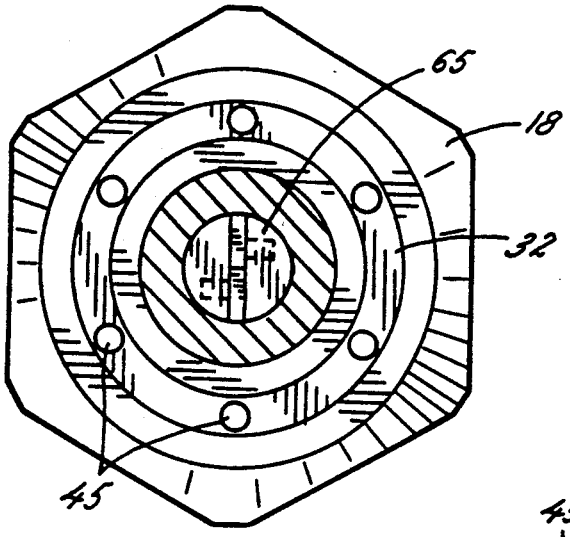
Figure 5:
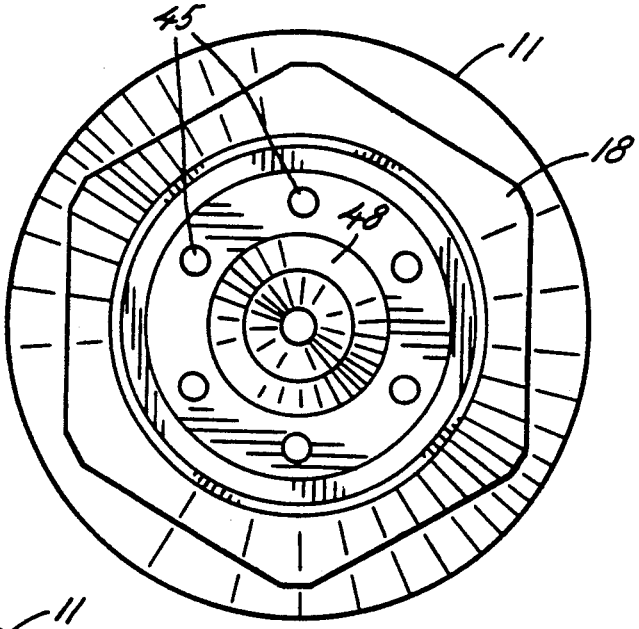
FIG. 5 is an elevational view of the discharge end of the nozzle assembly, with the end cap and union nut removed.
Figure 6:
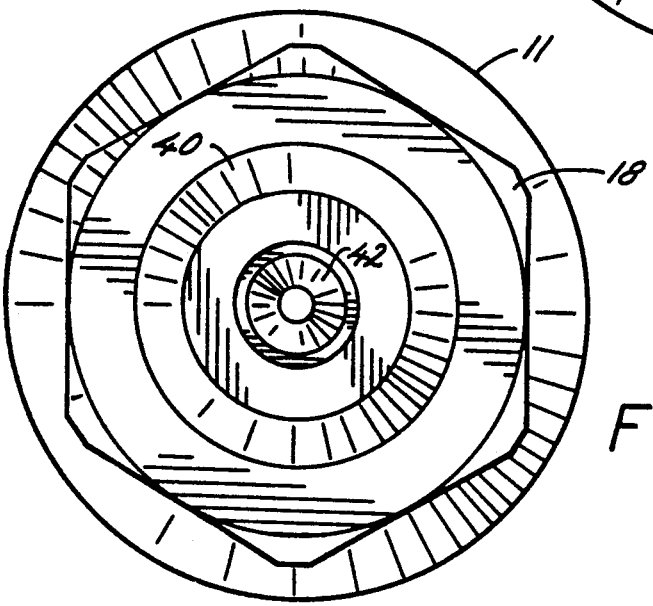
FIG. 6 is an elevational view of the discharge end of the nozzle with the end cap in place.

A liquid passage 20, defined by a slant bore 22 from the threaded socket 12 to an axial chamber 25, connects the source of pressurized liquid to the nozzle tip assembly 18. A sealing member or gasket 26, such as soft metallic copper, is positioned between the hollow support body 11 and the nozzle tip assembly 18 as shown in FIG. 1, and establishes a leak proof seal between the hollow support body 11 and the nozzle tip assembly 18 when the hub 15 is screwed tightly into the threaded socket 14. As best shown in FIGS. 2 and 3, a second passage 28, for pressurized air, consisting of an outer air chamber 29 and a plurality of individual passageways 30, extends through the body section 11 and communicates with an inner, annular air chamber 32.

The nozzle tip assembly 18 includes an orifice 35 communicating with the liquid passage 25, and further comprises a concentric end cap 40 which is shaped in a frusto-conical form, and which has a circular, centrally located discharge opening 42. The nozzle assembly 18 has a plurality of air passages defined by circular bores 45 communicating with the annular air chamber 32. The end cap 40 is located at the end of an annular threaded hub 48 associated with the nozzle assembly 18, and is secured in place by means of a retaining collar or union nut 50 having an internal flange 52 which engages an external annular shoulder 54 on the end cap 40.

Referring again to FIG. 1, the liquid orifice 35 is provided with a diverging outlet end 55 which produces a generally conical spray pattern. In accordance with one aspect of the present invention, compressed air is delivered via circular bores 45 into an annular cavity 60 formed between the diverging outlet end 55 of the liquid orifice 35 and the adjacent, interior surface of the conical end cap 40. The interior of the cap 40, including the cavity 60, is shaped to combine and turn the streams of air issuing from the bores 45 so that the air is directed inwardly, towards the center of the opening 42 formed in the cap. In this way, the end cap forms an annular slot 62 through which compressed air surrounds and impinges upon the liquid flowing from the orifice, and atomizes the liquid in the form of a cone shaped spray pattern.

The nozzle tip assembly is constructed and arranged so that the discharge of air through the slot 62 is in a direction generally transverse to the direction of the liquid spray discharge. This arrangement will produce a relatively wide angle spray pattern of substantially uniform thickness and droplet size. The interaction of the pressurized air with the liquid discharge from the nozzle tip feathers the edges of the spray pattern to eliminate excessive spray distribution in those areas. This provides a more uniform distribution of atomized liquid throughout the spray pattern, while at the same time increasing the velocity of the liquid discharge and the atomization of the liquid into finer and more uniform droplets. Due to the configuration of the nozzle tip, however, the supply of air may be used in reduced volume, or eliminated entirely. Although this will result in a somewhat wider spray pattern with an increased droplet size, the nozzle assembly will remain generally suitable for its intended purpose.

In accordance with another aspect of the present invention, the nozzle tip assembly includes a swirl imparting vane 65 in the axial chamber 25 which induces further turbulence in the chamber and which generates a uniform discharge through the liquid discharge orifice. The vane 65 includes an upstream flow divider web 66 and a pair of integrally formed semi-helical deflectors 68, 69 located downstream thereof. It will be understood that the deflectors impart a swirl-like motion to the liquid flowing therearound, causing it to rotate.

In accordance with a still further aspect of the invention, the nozzle assembly is constructed in a manner permitting quick disassembly and reassembly for cleaning. The nozzle tip is adapted to fit telescopically into the end cap 40, and the union nut 50 is threaded for connection to the nozzle tip assembly 18, which is, in turn, hexagonally shaped to enable a suitable wrench to be applied to tighten the connection between the nozzle tip assembly 18 and the hollow support body 11, as required.

While this invention has been disclosed primarily in terms of specific embodiments thereof, it is not intended to be limited thereto. Other modifications and embodiments will be apparent to those skilled in this art. For example, one could employ a plurality of air jets external to the discharge orifice 35 in lieu of the slotted arrangement 62 of the present invention. One could also replace the semi-helical vane 65 with comparable turbulence inducing means, without departing from the spirit or scope of the present invention.

I claim as my invention:

1. A full cone air atomizing nozzle assembly comprising, in combination, a body, means defining a liquid passage in said body, means for connecting an upstream end of said liquid passage to a pressurized liquid supply, said liquid passage having an annular, outwardly diverging discharge orifice at a downstream end thereof for directing a discharging liquid flow stream in a generally conical pattern, vane means disposed within said liquid passage for imparting a swirling, turbulence to liquid prior to discharge from said discharge orifice so that the discharging liquid is in the form of a conical spray pattern with liquid particles distributed throughout the pattern, means for defining an air passage in said body, means for connecting said air passage to a pressurized air supply, an end cap mounted on a downstream end of said body, said end cap an downstream body end defining an annular air chamber in communication with said air passage, said end cap having an annular opening and being internally configured for directing pressurized air generally transversely to the liquid flow stream discharging from said discharge orifice so that pressurized air surrounds and impinges the liquid flow stream subsequent to discharge from said discharge orifice to assist in atomization of the liquid while permitting the discharging flow stream to assume a conical spray pattern with liquid particles distributed throughout the pattern.

2. An air atomizing nozzle assembly according to claim 1 in which said body includes a support body an da separate nozzle body mounted on a downstream end of said support body.

3. An air atomizing nozzle assembly of according to claim 2 in which said support body and nozzle body are in threaded engaging relation to each other.

4. An air atomizing nozzle according to claim 3 in which said end cap has a frusto-conical internal form.

5. An air atomizing nozzle of claim 1 in which said end cap and downstream body end define an air outlet in the form of an annular slot.

6. An air atomizing nozzle of claim 5 in which said air passage includes an annular air passageway in said support body and a plurality of passageways in said nozzle body in communication with said annular chamber.

7. An air atomizing nozzle assembly according to claim 1, wherein the whirl imparting vane comprises a flow divider web and a pair of integrally formed semi-helical deflectors.

8. An atomizing nozzle assembly according to claim 3, wherein said support body has a first threaded socket for attachment to said source of pressurized liquid, and a second annular socket for coupling to said source of pressurized air.

* * * * *